US006074503A

United States Patent [19]

Clark et al.

[11] Patent Number: 6,074,503

[45] Date of Patent: Jun. 13, 2000

[54] MAKING ENHANCED DATA CABLE WITH CROSS-TWIST CABLED CORE PROFILE

[75] Inventors: William T. Clark, Lancaster; Peter D. MacDonald, Gardner; Joseph Dellagala, Shrewsbury, all of Mass.

[73] Assignee: Cable Design Technologies, Inc., Leominster, Mass.

[21] Appl. No.: 08/841,440

[22] Filed: Apr. 22, 1997

[51] Int. Cl.[7] ..... H01B 13/00

[52] U.S. Cl. ..... 156/50; 156/47; 156/55; 174/131 A

[58] Field of Search ..... 156/47, 50, 55, 156/52, 244.15; 174/70 C, 34, 36, 99 R, 116, 113 A, 131 R, 131 A; 385/105, 107, 110, 112; 264/1.28; 57/6, 12, 13

[56] References Cited

U.S. PATENT DOCUMENTS

| | | | |
|---|---|---|---|
| 483,285 | 9/1892 | Guilleaume | 174/113 C |
| 1,132,452 | 3/1915 | Davis | 174/116 |
| 1,700,606 | 1/1929 | Beaver | 174/116 |
| 1,977,209 | 10/1934 | Sargent | 174/131 A |
| 1,995,201 | 3/1935 | Delon | 156/55 |
| 2,501,457 | 3/1950 | Thelin | 174/116 |
| 2,882,676 | 4/1959 | Bryan et al. | 57/138 |
| 3,340,112 | 9/1967 | Davis et al. | 156/47 |
| 3,559,390 | 2/1971 | Staschewski | 156/47 |
| 3,603,715 | 9/1971 | Eilhardt et al. | 174/15 |
| 3,644,659 | 2/1972 | Campbell | 174/27 |
| 3,819,443 | 6/1974 | Simons et al. | 156/204 |
| 4,778,246 | 10/1988 | Carroll | 385/107 |
| 5,149,915 | 9/1992 | Brunker et al. | 174/36 |
| 5,418,878 | 5/1995 | Sass et al. | 385/101 |
| 5,544,270 | 8/1996 | Clark et al. | 385/101 |
| 5,574,250 | 11/1996 | Hardie et al. | 174/36 |
| 5,789,711 | 8/1998 | Gaeris et al. | 174/131 A |

FOREIGN PATENT DOCUMENTS 43 36 230 C1 3/1995 Germany .

OTHER PUBLICATIONS images of Belden 1711A Datatwist 300 4PR23 shielded cable, Sep. 11, 1995.

*Primary Examiner*—Geoffrey L. Knable
*Attorney, Agent, or Firm*—Wolf, Greenfield & Sacks, P.C.

[57] ABSTRACT

A cable exhibiting reduced crosstalk between transmission media includes a core having a profile with a shape which defines spaces or channels to maintain a spacing between transmission media in a finished cable. The core is formed of a conductive material to further reduce crosstalk. A method of producing a cable introduces a core as described above into the cable assembly and imparts a cable closing twist to the assembly.

4 Claims, 2 Drawing Sheets

MAKING ENHANCED DATA CABLE WITH CROSS-TWIST CABLED CORE PROFILE

BACKGROUND

1. Field of the Invention

The present invention relates to high-speed data communications cables using at least two twisted pairs of wires. More particularly, it relates to cables having a central core defining plural individual pair channels.

2. Related Art

High-speed data communications media in current usage include pairs of wire twisted together to form a balanced transmission line. Such pairs of wire are referred to as twisted pairs.

One common type of conventional cable for high-speed data communications includes multiple twisted pairs. When twisted pairs are closely placed, such as in a cable, electrical energy may be transferred from one pair of a cable to another. Such energy transferred between pairs is undesirable and referred to as crosstalk. The Telecommunications Industry Association and Electronics Industry Association have defined standards for crosstalk, including TIA/EIA-568A. The International Electrotechnical Commission has also defined standards for data communication cable crosstalk, including ISO/IEC 11801. One high-performance standard for 100Ω cable is ISO/IEC 11801, Category 5.

In conventional cable, each twisted pair of a cable has a specified distance between twists along the longitudinal direction, that distance being referred to as the pair lay. When adjacent twisted pairs have the same pair lay and/or twist direction, they tend to lie within a cable more closely spaced than when they have different pair lays and/or twist direction. Such close spacing increases the amount of undesirable crosstalk which occurs. Therefore, in some conventional cables, each twisted pair within the cable has a unique pair lay in order to increase the spacing between pairs and thereby to reduce the crosstalk between twisted pairs of a cable. Twist direction may also be varied. Along with varying pair lays and twist directions, individual solid metal or woven metal pair shields are sometimes used to electromagnetically isolate pairs.

Shielded cable, although exhibiting better crosstalk isolation, is more difficult and time consuming to install and terminate. Shield conductors are generally terminated using special tools, devices and techniques adapted for the job.

One popular cable type meeting the above specifications is Unshielded Twisted Pair (UTP) cable. Because it does not include shield conductors, UTP is preferred by installers and plant managers, as it is easily installed and terminated. However, UTP fails to achieve superior crosstalk isolation, as required by state of the art transmission systems, even when varying pair lays are used.

Another solution to the problem of twisted pairs lying too closely together within a cable is embodied in a cable manufactured by Belden Wire & Cable Company as product number 1711 A. This cable includes four twisted pair media radially disposed about a "+"-shaped core. Each twisted pair nests between two fins of the "+"-shaped core, being separated from adjacent twisted pairs by the core. This helps reduce and stabilize crosstalk between the twisted pair media. However, the core adds substantial cost to the cable, as well as material which forms a potential fire hazard, as explained below, while achieving a crosstalk reduction of only about 5dB.

In building design, many precautions are taken to resist the spread of flame and the generation of and spread of smoke throughout a building in case of an outbreak of fire. Clearly, it is desired to protect against loss of life and also to minimize the costs of a fire due to the destruction of electrical and other equipment. Therefore, wires and cables for in building installations are required to comply with the various flammability requirements of the National Electrical Code (NEC) and/or the Canadian Electrical Code (CEC).

Cables intended for installation in the air handling spaces (ie. plenums, ducts, etc.) of buildings are specifically required by NEC or CEC to pass the flame test specified by Underwriters Laboratories Inc. (UL), UL-910, or it's Canadian Standards Association (CSA) equivalent, the FT6. The UL-910 and the FT6 represent the top of the fire rating hierarchy established by the NEC and CEC respectively. Cables possessing this rating, generically known as "plenum" or "plenum rated", may be substituted for cables having a lower rating (ie. CMR, CM, CMX, FT4, FT1 or their equivalents), while lower rated cables may not be used where plenum rated cable is required.

Cables conforming to NEC or CEC requirements are characterized as possessing superior resistance to ignitability, greater resistant to contribute to flame spread and generate lower levels of smoke during fires than cables having a lower fire rating. Conventional designs of data grade telecommunications cables for installation in plenum chambers have a low smoke generating jacket material, e.g. of a PVC formulation or a fluoropolymer material, surrounding a core of twisted conductor pairs, each conductor individually insulated with a fluorinated ethylene propylene (FEP) insulation layer. Cable produced as described above satisfies recognized plenum test requirements such as the "peak smoke" and "average smoke" requirements of the Underwriters Laboratories, Inc., UL910 Steiner test and/or Canadian Standards Association CSA-FT6 (Plenum Flame Test) while also achieving desired electrical performance in accordance with EIA/TIA-568A for high frequency signal transmission.

While the above-described conventional cable including the Belden 1711 A cable due in part to their use of FEP meets all of the above design criteria, the use of fluorinated ethylene propylene is extremely expensive and may account for up to 60% of the cost of a cable designed for plenum usage.

The solid core of the Belden 1711 A cable contributes a large volume of fuel to a cable fire. Forming the core of a fire resistant material, such as FEP, is very costly due to the volume of material used in the core.

Solid flame retardant/smoke suppressed polyolefin may also be used in connection with FEP. Solid flame retardant/smoke suppressed polyolefin compounds commercially available all possess dielectric properties inferior to that of FEP. In addition, they also exhibit inferior resistance to burning and generally produce more smoke than FEP under burning conditions than FEP.

SUMMARY OF THE INVENTION

This invention provides an improved data cable.

According to one embodiment, the cable includes a plurality of transmission media; a core having a surface defining recesses within which each of the plurality of transmission media are individually disposed; and an outer jacket maintaining the plurality of data transmission media in position with respect to the core.

According to another embodiment of the invention, a cable includes a plurality of transmission media radially disposed about a core having a surface with features which maintain a separation between each of the plurality of transmission media.

Finally, according to yet another embodiment of the invention, there is a method of producing a cable. The method first passes a plurality of transmission media and a core through a first die which aligns the plurality of transmission media with surface features of the core and prevents twisting motion of the core. Next, the method bunches the aligned plurality of transmission media and core using a second die which forces each of the plurality of transmission media into contact with the surface features of the core which maintain a spatial relationship between each of the plurality of transmission media. Finally, the bunched plurality of transmission media and core are twisted to close the cable, and the closed cable is jacketed.

BRIEF DESCRIPTION OF THE DRAWINGS

In the drawings, in which like reference numerals designate like elements.

DETAILED DESCRIPTION

An embodiment of the invention is now described in which a cable is constructed to include four twisted pairs of wire and a core having a unique profile. However, the invention is not limited to the number of pairs or the profile used in this embodiment. The inventive principles can be applied to cables including greater or fewer numbers of twisted pairs and different core profiles. Also, although this embodiment of the invention is described and illustrated in connection with twisted pair data communication media, other high-speed data communication media can be used in constructions of cable according to the invention.

Figure 1:
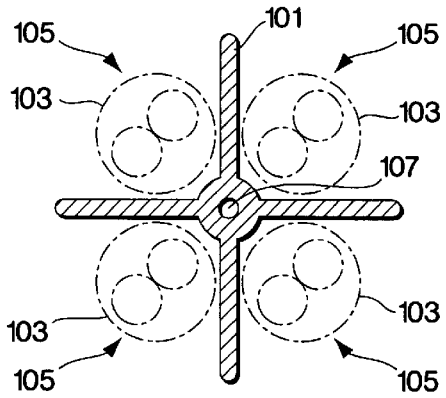
FIG. 1 is a cross-sectional view of a cable core used in embodiments of the invention.

This illustrative embodiment of the invention, as shown in FIG. 1, includes an extruded core 101 having a profile described below cabled into the cable with four twisted pairs 103. The extruded core profile has an initial shape of a "+", providing four spaces or channels 105 between each pair of fins of the core. Each channel 105 carries one twisted pair 103 placed within the channel 105 during the cabling operation. The illustrated core 101 and profile should not be considered limiting. The core 101 may be made by some other process than extrusion and may have a different initial shape or number of channels 105. For example, there may be an optional central channel 107 provided to carry a fiber optic element.

The above-described embodiment can be constructed using a number of different materials. While the invention is not limited to the materials now given, the invention is advantageously practiced using these materials. The core material should be a conductive material or one containing a powdered ferrite, the core material being generally compatible with use in data communications cable applications, including any applicable fire safety standards. In non-plenum applications, the core can be formed of solid or foamed flame retardant polyolefin or similar materials. In plenum applications, the core can be any one or more of the following compounds: a solid low dielectric constant fluoropolymer, e.g., ethylene chlortrifluoroethylene (E-CTFE) or fluorinated ethylene propylene (FEP), a foamed fluoropolymer, e.g., foamed FEP, and polyvinyl chloride (PVC) in either solid, low dielectric constant form or foamed. A filler is added to the compound to render the extruded product conductive. Suitable fillers are those compatible with the compound into which they are mixed, including but not limited to powdered ferrite, semiconductive thermoplastic elastomers and carbon black. Conductivity of the core helps to further isolate the twisted pairs from each other.

A conventional four-pair cable including a non-conductive core, such as the Belden 1711 A cable, reduces nominal crosstalk by up to 5dB over similar, four-pair cable without the core. By making the core conductive, crosstalk is reduced a further 5dB. Since both loading and jacket construction can affect crosstalk, these figures compare cables with similar loading and jacket construction.

Figure 2:
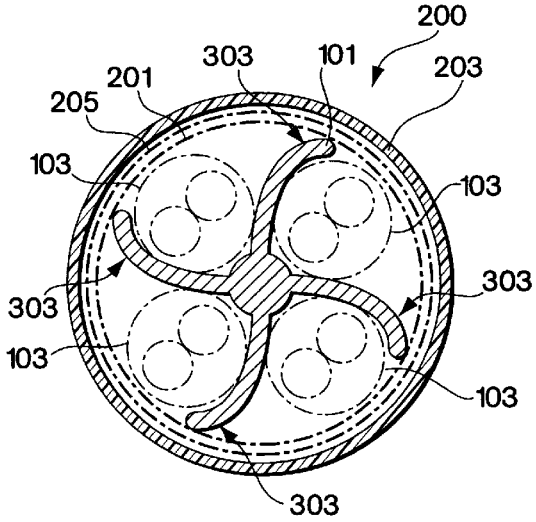
FIG. 2 is a cross-sectional view of one embodiment of a cable including the core of FIG. 1.

The cable may be finished in any one of several conventional ways, as shown in FIG. 2. The combined core 101 and twisted pairs 103 may be optionally wrapped with a dielectric tape 201, then jacketed 205 to form cable 200. An overall conductive shield 205 can optionally be applied over the cable before jacketing to prevent the cable from causing or receiving electromagnetic interference. The jacket 203 may be PVC or another material as discussed above in relation to the core 101. The dielectric tape 201 may be polyester, or another compound generally compatible with data communications cable applications, including any applicable fire safety standards.

Figure 3:
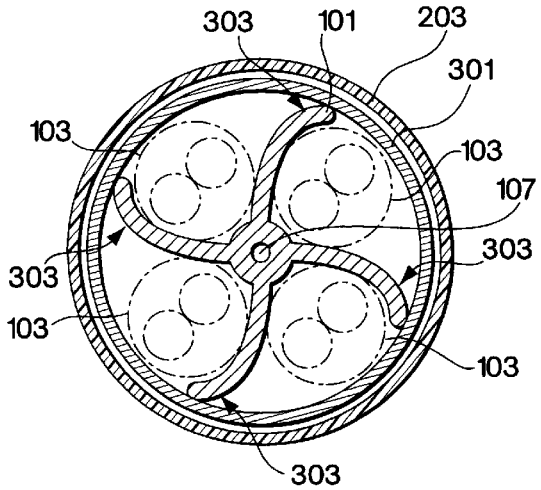
FIG. 3 is a cross-sectional view of another embodiment of a cable including the core of FIG. 1.
Figure 4:
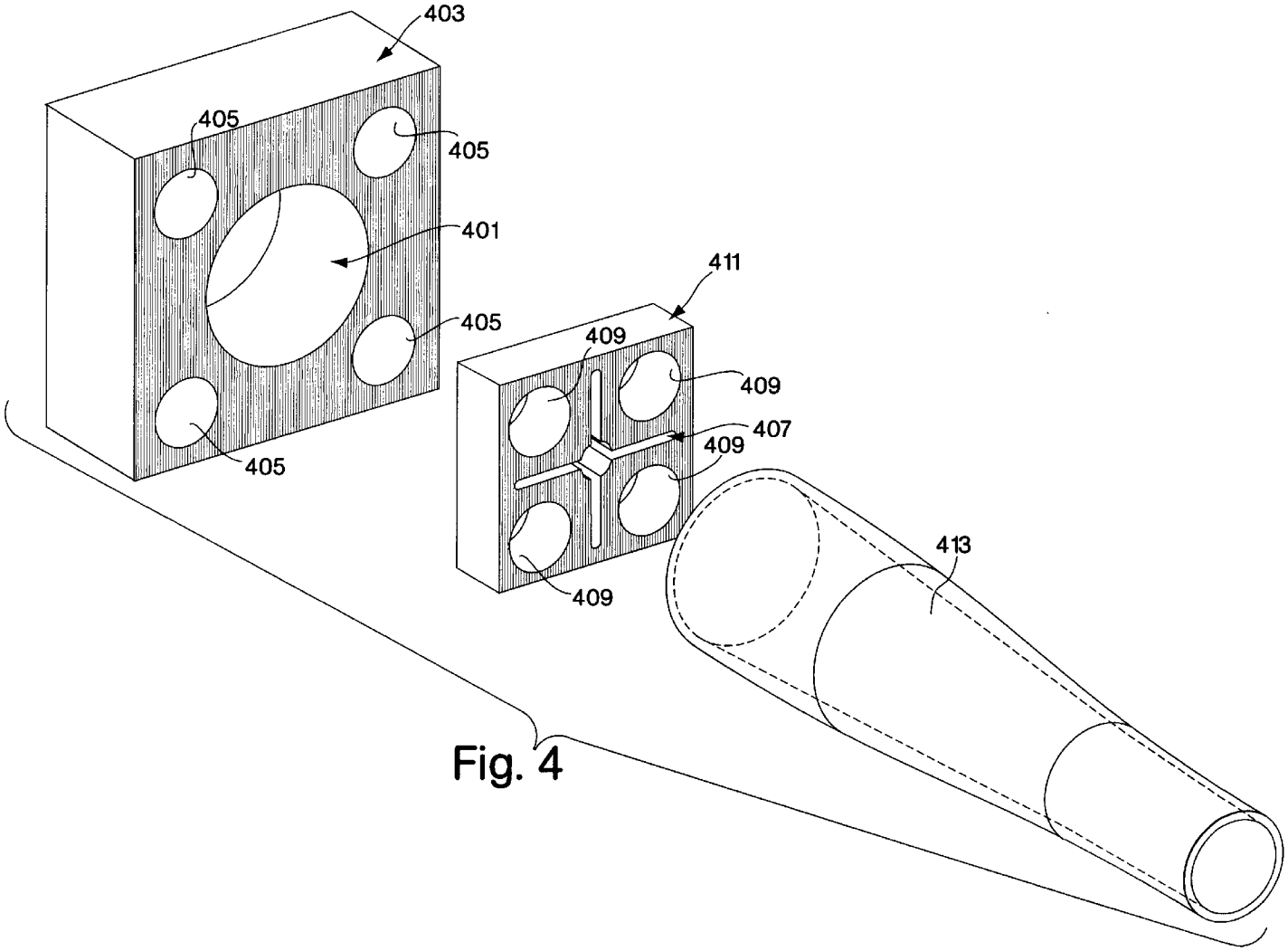
FIG. 4 is a perspective view of a die system for practicing a method of making a cable in accordance with another embodiment of the invention.

Greater crosstalk isolation is achieved in the construction of FIG. 3, by using a conductive shield 301, for example a metal braid, a solid metal foil shield or a conductive plastic layer in contact with the ends of the fins 303 of the core 101. Such a construction rivals individual shielding of twisted pairs for crosstalk isolation. This construction optionally can advantageously include a drain wire in a central channel 107. In the constructions of both FIGS. 2 and 3 it is advantageous to have the fins 303 of the core 101 extend somewhat beyond a boundary defined by the outer dimension of the twisted pairs 103. In the construction of FIG. 2 this ensures that he twisted pairs 103 do not escape their respective channels 105 prior to the cable being jacketed, while in that of FIG. 3 and good contact between the fins 303 and the shield 301 is ensured. In both constructions, closing and jacketing the cable may bend the tips of the fins 303 over slightly, as shown in the core material is relatively soft, such as PVC.

A method of making cable in accordance with the above-described embodiments is now described.

As is known in this art, when plural elements arc cabled together, an overall twist is imparted to the assembly to improve geometric stability and help prevent separation. In embodiments of the present invention, twisting of the profile of the core along with the individual twisted pairs is controlled. The process allows the extruded core to maintain a physical spacing between the twisted pairs and maintains geometrical stability within the cable. Thus, the process assists in the achievement of and maintenance of high crosstalk isolation by placing a conductive core in the cable to maintain pair spacing.

Cables of the previously described embodiments, can be made by a three-part die system. However, methods of making such cables are not limited to a three-part die system, as more or fewer die elements can be constructed to incorporate the features of the invention.

The extruded core is drawn from a payoff reel (not shown) through the central opening 401 in die 403. Four twisted pairs are initially aligned with the core by passing through openings 405 in die 403. The core is next brought through opening 407 and brought together with the four twisted pairs which are passed through openings 409 in a second die 411, then cabled with the twisted pairs which are pushed into the channels of the core by a third die 413, in an operation called bunching. The second die 411 eliminates back twist, which is inherent in bunching operations, thus allowing the third die 413 to place the pairs in the channels prior to the twisting. The cable twist is imparted to the cable assembly after the second die 411, which locates the twisted pairs relative to the extruded core profile.

Although the method of making cable has been described in connection with an extruded core delivered into the process from a payoff reel, the invention is not so limited. For example, the core could be extruded immediately prior to use and transferred directly from the extruder to the central opening 401 of the first die 403. In another variation, the core could be extruded directly through a properly shaped central opening of either the first die 403 or the second die 411.

The present invention has now been described in connection with a number of specific embodiments thereof. However, numerous modifications which are contemplated as falling within the scope of the present invention should now be apparent to those skilled in the art. Therefore, it is intended that the scope of the present invention be limited only by the scope of the claims appended hereto.

What is claimed is:

1. A method of producing a cable, comprising steps of:

passing a plurality of transmission media and a core through a first die which aligns the plurality of transmission media with surface features of the core and prevents twisting motion of the core;

bunching the aligned plurality of transmission media and core using a second die which forces each of the plurality of transmission media into contact with the surface features of the core which maintain a spatial relationship between each of the plurality of transmission media;

twisting the bunched plurality of transmission media and core to close the cable; and jacketing the closed cable.

2. The method of claim 1, further comprising the steps of:

before passing the transmission media and the core through the first die, passing the transmission media and the core through a third die which generally centers the core relative to the plurality of transmission media.

3. The method of claim 2 wherein the step of passing the transmission media and the core thorugh the third die further comprises:

extruding the core at a center position relative to the plurality of transmission media.

4. The method of claim 1, wherein the step of passing further comprises:

extruding the core so that the surface features thereof align with the plurality of transmission media.

* * * * *

US006074503C1

(12) EX PARTE REEXAMINATION CERTIFICATE (7790th)

United States Patent
Clark et al.

(10) Number: US 6,074,503 C1
(45) Certificate Issued: Oct. 5, 2010

(54) MAKING ENHANCED DATA CABLE WITH CROSS-TWIST CABLED CORE PROFILE

(75) Inventors: William T. Clark, Lancaster, MA (US); Peter D. MacDonald, Gardner, MA (US); Joseph Dellagala, Shrewsbury, MA (US)

(73) Assignee: Belden Technologies, Inc., St. Louis, MO (US)

Reexamination Request:
No. 90/009,466, Jul. 9, 2009

Reexamination Certificate for:

| | |
|---|---|
| Patent No.: | **6,074,503** |
| Issued: | **Jun. 13, 2000** |
| Appl. No.: | **08/841,440** |
| Filed: | **Apr. 22, 1997** |

(51) Int. Cl.
*H01B 11/02* (2006.01)
*H01B 11/08* (2006.01)

(52) U.S. Cl. ..... 156/50; 156/55; 156/47; 174/131 A

(58) Field of Classification Search ..... None
See application file for complete search history.

(56) References Cited

U.S. PATENT DOCUMENTS

| | | | |
|---|---|---|---|
| 2,792,442 | A | 5/1957 | Parce |
| 3,055,967 | A | 9/1962 | Bondon |
| 3,622,683 | A | 11/1971 | Roberts et al. |
| 3,715,877 | A | 2/1973 | Akachi |
| 3,911,200 | A | 10/1975 | Simons et al. |
| 3,921,378 | A | 11/1975 | Spicer et al. |
| 4,205,899 | A | 6/1980 | King et al. |
| 4,257,675 | A | 3/1981 | Nakagome et al. |
| 4,319,940 | A | 3/1982 | Arroyo et al. |
| 4,385,485 | A | 5/1983 | Yonechi |
| 4,393,582 | A | 7/1983 | Arnold, Jr. et al. |
| 4,411,130 | A | 10/1983 | Dubois et al. |
| 4,428,787 | A | 1/1984 | Pan et al. |
| 4,459,799 | A | 7/1984 | Beucher |
| 4,600,268 | A | 7/1986 | Spicer |
| 4,644,098 | A | 2/1987 | Norris et al. |
| 4,645,628 | A | 2/1987 | Gill |
| 4,697,051 | A | 9/1987 | Beggs et al. |
| 4,712,368 | A | 12/1987 | Garner |
| 4,755,629 | A | 7/1988 | Beggs et al. |
| 4,784,461 | A | 11/1988 | Abe et al. |
| 4,784,462 | A | 11/1988 | Priaroggia |
| 5,087,110 | A | 2/1992 | Inagaki et al. |
| 5,115,485 | A | 5/1992 | Gandy |
| 5,424,491 | A | 6/1995 | Walling et al. |
| 5,767,441 | A | 6/1998 | Brorein et al. |
| 5,969,295 | A | 10/1999 | Boucino et al. |
| 6,255,593 | B1 | 7/2001 | Reede |
| 6,570,095 | B2 | 5/2003 | Clark et al. |
| 6,998,537 | B2 | 2/2006 | Clark et al. |
| 7,179,999 | B2 | 4/2007 | Clark et al. |
| 7,339,116 | B2 | 3/2008 | Gareis et al. |

FOREIGN PATENT DOCUMENTS

| | | |
|---|---|---|
| CA | 2058046 | 8/1992 |

(Continued)

OTHER PUBLICATIONS

Trent M. Hays, presentation entitled, "Evaluation of Alien Crosstalk in Cat 5e and Cat 6 Installations" IEEE 802.3 10GBASE–T Study Group, Mar. 2003.
Chris DiMinico, "Lower cost copper solutions may drive 1–Gigabit Ethernet," Aug. 1, 2003.
Excerpts from Belden Inc., Form 10–K, for the fiscal year ended Dec. 31, 2008.
Merriam–Webster Online Dictionary.
Comprehensive Dictionary of Electrical Engineering 188 (2nd ed. 2005).
Electronics Engineers' Handbook 1.3.1.

*Primary Examiner*—Stephen J Stein

(57) ABSTRACT

A cable exhibiting reduced crosstalk between transmission media includes a core having a profile with a shape which defines spaces or channels to maintain a spacing between transmission media in a finished cable. The core is formed of a conductive material to further reduce crosstalk. A method of producing a cable introduces a core as described above into the cable assembly and imparts a cable closing twist to the assembly.

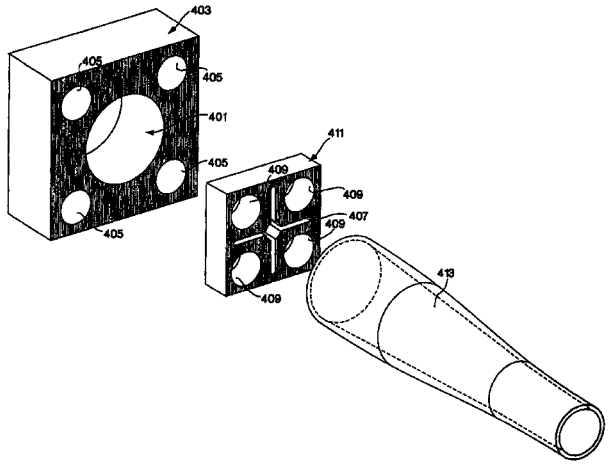

FOREIGN PATENT DOCUMENTS

| | | |
|---|---|---|
| DE | 697378 | 10/1940 |
| DE | 24 59 844 | 7/1946 |
| DE | 9011484 | 11/1990 |
| EP | 0961296 | 1/1999 |
| EP | 1059343 | 12/2000 |
| EP | 1085530 | 3/2001 |
| EP | 1162632 | 12/2001 |
| FR | 694100 | 11/1930 |
| FR | 1265877 | 5/1961 |
| FR | 2706068 | 12/1994 |
| FR | 2751779 | 1/1998 |
| GB | 725624 | 3/1955 |
| JP | SHO56-7307 | 1/1981 |
| JP | 5719910 | 2/1982 |
| JP | SHO57-19910 | 2/1982 |
| JP | 4332406 | 11/1992 |
| JP | HEI8-96635 | 4/1996 |
| WO | 9848430 | 10/1998 |
| WO | 0051142 | 8/2000 |
| WO | 2005041219 | 5/2005 |

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-4 is confirmed.

New claims 5 and 6 are added and determined to be patentable.

*5. The method of claim 1, further comprising:*

*providing as the plurality of transmission media, a plurality of twisted pairs of insulated conductors.*

*6. The method of claim 5, further comprising:*

*providing as the plurality of transmission media, four twisted pairs of insulated conductors.*

* * * * *

(12) INTER PARTES REVIEW CERTIFICATE (121st)
United States Patent
Clark et al.

(10) Number: US 6,074,503 K1
(45) Certificate Issued: Apr. 21, 2016

(54) MAKING ENHANCED DATA CABLE WITH CROSS-TWIST CABLED CORE PROFILE

(75) Inventors: William T. Clark; Peter D. MacDonald; Joseph Dellagala

(73) Assignee: BELDEN TECHNOLOGIES, INC.

Trial Number:

IPR2013-00057 filed Nov. 19, 2012

Petitioners: Nexans, Inc.; Berk-Tek, LLC

Patent Owner: Belden, Inc.

Inter Partes Review Certificate for:

| | |
|---|---|
| Patent No.: | **6,074,503** |
| Issued: | **Jun. 13, 2000** |
| Appl. No.: | **08/841,440** |
| Filed: | **Apr. 22, 1997** |

The results of IPR2013-00057 are reflected in this inter partes review certificate under 35 U.S.C. 318(b).

INTER PARTES REVIEW CERTIFICATE
U.S. Patent 6,074,503 K1
Trial No. IPR2013-00057
Certificate Issued Apr. 21, 2016

AS A RESULT OF THE INTER PARTES REVIEW PROCEEDING, IT HAS BEEN DETERMINED THAT:

Claims 5 and 6 are found patentable.

Claims 1, 2, 3 and 4 are cancelled.

* * * * *